United States Patent [19]

Bouche-Pillon et al.

[11] Patent Number: 4,952,298

[45] Date of Patent: Aug. 28, 1990

[54] CORRECTIVE CONTROLLER SYSTEM FOR ELECTROLYTIC CELLS

[75] Inventors: Bernard Bouche-Pillon, Lavera; Rene Clair, Martigues; Jean-Pierre Caujolle, Chaponost, all of France

[73] Assignee: Atochem, Puteaux, France

[21] Appl. No.: 324,822

[22] Filed: Mar. 17, 1989

[30] Foreign Application Priority Data

Mar. 17, 1988 [FR] France ..... 88 03446

[51] Int. Cl.[5] ..... C25B 9/00; C25B 15/08

[52] U.S. Cl. ..... 204/228; 204/241; 204/255; 204/257; 204/263; 204/275; 204/406; 204/408

[58] Field of Search ..... 204/98, 228, 229, 252–258, 204/263–266, 275–278, 406, 408, 241

[56] References Cited

U.S. PATENT DOCUMENTS 4,285,786 8/1981 Larson ..... 204/98
4,767,511 8/1988 Aragon ..... 204/228 X
4,786,379 11/1988 Barnett ..... 204/228 X
4,836,903 6/1989 Cawlfield ..... 204/255 X
4,857,158 8/1989 Cawlfield ..... 204/406 X

FOREIGN PATENT DOCUMENTS 0136806 4/1985 European Pat. Off. .

*Primary Examiner*—Donald R. Valentine
*Attorney, Agent, or Firm*—Burns, Doane, Swecker & Mathis

[57] ABSTRACT

An electrolytic cell, e.g., for the electrolysis of NaCl to produce chlorine and sodium hydroxide, has an improved operation control system, such system including a plurality of means for monitoring and controlling the flowstreams of inlet starting materials and/or outlet final products, the temperature of the electrolyte, the various reagent concentrations and the cell current, and such plurality of means being operably connected to a computing function which carries out corrective coherence calculations on certain of the parameters of electrolysis and adjusts the operation of the cell in response thereto.

11 Claims, No Drawings

CORRECTIVE CONTROLLER SYSTEM FOR ELECTROLYTIC CELLS

BACKGROUND OF THE INVENTION

1. Field of the Invention

The present invention relates to a process for controlling the operation of an electrolytic cell, for example, for controlling the electrolysis of aqueous solutions of sodium chloride (the only industrial process for producing chlorine and sodium hydroxide).

More especially, rather than employing, for example, a flow rate measurement for actuating a flow rate controller, and simultaneously a concentration measurement for actuating a temperature controller, all of the measurements are centralized according to this invention, such measurements being made coherent with the overall cell balance and appropriate signals being delivered to the various controllers.

2. Description of the Prior Art

Electrolysis is a process carried out industrially to produce, for example, alkali metal chlorates or alkali metal hydroxides. The electrolysis of sodium chloride solutions to produce chlorine and sodium hydroxide is the most important in terms of the final tonnages produced and because it is the only industrial-scale process employed today; see, for example, Kirk-Othmer, *Encyclopedia of Chemical Technology*, 3rd edition, pages 799 to 865.

It is known to this art that control of the operation of a cell or group of electrolysis cells is generally effected by means of a servo system utilizing the parameter values supplied by characteristic sensors of the element(s) or compounds entering or exiting the installation. These values permit control over the operation of the installation, by virtue of control means to which a set point signal is supplied, together with signals corresponding to some of the parameters (for example the concentrations of residual compounds exiting the installation). These means of control supply a command signal which makes it possible, in particular, to issue commands to means for controlling the flow rates of the starting materials introduced into the apparatus.

Control systems of this type, which are well known to this art, incorporate at least one control loop and present disadvantages by reason of the fact that the values of the parameters supplied by the sensors are approximate values of these characteristic parameters and not highly accurate values. Consequently, a control device whose operation is based directly on the values of the characteristic parameters supplied by sensors does not permit an optimum control set point to enable an electrolysis cell to operate at an optimum efficiency.

The prior art proposes specific control systems for electrolysis cells. U.S. Pat. No. 4,035,268 describes a device for adjusting the separation of the electrodes in what is commonly designated a "mercury" cell process. European Patent EP No. 99,795 describes a system for controlling the current of a group of electrolysis cells. As above, these devices are only improved conventional controls, namely, those wherein a parameter has been analyzed and measured more precisely and then transmitted to a conventional controller.

SUMMARY OF THE INVENTION

Accordingly, a major object of the present invention is the provision of an improved control system for controlling the operation of an electrolytic cell, particularly by monitoring the values of a large number of parameters, and making a corrective calculation of the values of these parameters, such as to permit the operation of the facility to be controlled at a maximum efficiency. This corrective calculation is, in fact, a coherence calculation of the values of the parameters which are measured.

Briefly, the present invention features a system for controlling operation of an electrolytic cell, comprising:

(a) measuring means which supply signals of measurement of the flow rates of at least one of the inlet starting materials and at least one of the outlet final products;

(b) if desired, means for controlling the flow rate of at least one of the inlet or outlet materials;

(c) at least one means for measuring the temperature of the electrolyte and, if desired, at least one means for controlling this temperature;

(d) computing means connected to the flow rate measuring means (a), and to the means (c) for measuring the temperature of the electrolyte, and further wherein:

(i) the computing means (d) are connected to at least one means for measuring the current;

(ii) the computing means (d) carry out the coherence treatments of the flow rate measurements supplied by the measuring means (a) and of the measurement of the current; and (iii) the computing means (d) supply at least one signal improved by the coherence treatment and applicable to at least one of (1) the measuring means (b) for controlling the flow rates, (2) a means for controlling the current, and/or (3) the means for controlling the temperature.

DETAILED DESCRIPTION OF THE PREFERRED EMBODIMENTS OF THE INVENTION

More particularly according to the present invention, by "electrolytic" or "electrolysis cell" is intended any device in which at least one chemical reaction is carried out under the effect of a difference of potential and of a current supplied by an electrical generator. Representative such reactions are, for example, the electrolysis of sodium chloride to produce sodium chlorate, of hydrofluoric acid to produce elemental fluorine, or of sodium chloride in aqueous solution to produce chlorine and sodium hydroxide, which is known as "chlorine/-sodium hydroxide electrolysis". This chlorine/sodium hydroxide electrolysis is generally carried out according to any one of three industrial processes, namely:

(i) The mercury process;

(ii) The diaphragm process; and (iii) The membrane process.

The term "electrolysis (or electrolytic) cell" also refers to a group or array of electrolysis cells By "inlet starting material" is intended any feedstream of material entering the cell, for example the sodium chloride solution. By analogy, "outlet final product" refers to a stream of material exiting the cell, for example the sodium hydroxide and sodium chloride solution from a diaphragm process, or the sodium hydroxide solutions and the depleted sodium chloride solutions of the membrane and mercury processes. The gas stream consisting essentially of hydrogen is also an outlet final product of a chlorine/sodium hydroxide electrolysis cell. The measuring means (a) are any usual system for measuring a gas or liquid flow rate, such as, for example, a diaphragm, a venturi or a meter. All of these systems deliver a signal representing the flow rate. The signal may be in an electrical form, such as a voltage or a current, and may be either analog or digital, or also in a radioelectric form. It may also be a pneumatic signal which can be converted into an electrical signal.

The control means (b) are, for example, means which function by changing the pressure drop of an inlet or outlet material. Pneumatic valves or solenoid valves are generally employed. Variable-speed pumps can also be used.

The means (c) for measuring the temperature of the electrolyte are means which are per se known to this art. They may be located near the electrodes in the cell, or in a pipe through which flows the electrolyte entering or exiting the cell. Like the means (a), these means (c) deliver signals, electrical in most cases, representing the temperature. The means for controlling the temperature of the electrolyte may be known heat exchange means. The temperature of the electrolyte entering the cell can also be modified by the use of these means.

The computing means (d) are also means which are per se known to this art and which comprise, for example, analog or digital, or analog and digital, electronic computing circuits, and which are linked to the measuring means (a) and (c) by conventional links. The computing means (d) are preferably devices of the computer type which can perform numerical and logic operations according to preprogrammed instructions and according to preprogrammed values and values or data transmitted by the measuring means (a) and (c). These computing means (d) are preferably supplemented by display means, such as screens or printers, and means for storing data, such as magnetic means.

The cell current is the electrical current which is measured between the electrodes or, for example, between the anodes and the mercury bed in the case of a mercury cell. "Current" also refers to the current of a group of cells. The means for measuring the current are the customary means used by electrical engineers. Likewise as regards the means for controlling this current. For example, to control the current, an action on the voltage of the diodes, of one or more rectifiers, and/or on the striking angle of the thyristors of the rectifiers may be used. The means for measurement may also coincide with the control means.

The means for measuring the current, like the means (a) and (c), deliver signals representing this current These analog or digital signals are preferably electrical in nature. The means for measuring the current are linked to the computing means (d). In most cases, these linkages are actually electrical conductor cables, but the use of linkages employing radio or infrared waves is also within the scope of this invention.

The measurement of the current, the measurement(s) supplied by the means (a) and the measurement(s) of temperature supplied by the means (c) are operably linked to the computing means (d) which perform the coherence treatments of these measurements. Thus, the computing means (d), aided by the mathematical models and the physical and chemical laws which apply to electrolysis, compare these measurements with each other, correlate them, using even a partial balance of the electrolysis cell, and determine the most probable values of the measured values and of other values Which are not measured, and Which are deduced by calculation, and are thus able to supply a signal which is improved (by these computing means (d)) and which can be sent to the control means, either of one of the flow rates, or of the current, or of the temperature of the electrolyte. The computing means (d) are said to perform coherence treatments. The principle of a "coherence treatment" will be explained in greater detail below.

According to the invention, it is essential to measure the flow rate of one of the inlet materials or outlet products. For example, in chlorine/sodium hydroxide electrolysis, the brine flow rate, or the water flow rate, or the sodium hydroxide flow rate may be selected. It is also essential to measure the temperature of the electrolyte, as well as the electrical current in the cell, and all of these measurements are then made coherent, if desired by being linked via physicochemical relationships which must be observed. For example, the quantity of hydrogen produced may be linked with the current. The computing means (d) supply at least one control signal which can be sent to the means for controlling the current, or one of the inlet or outlet materials, or the temperature. Control of an inlet or outlet material which is different from that whose measurement has been used for the coherence calculation may be selected. As an example, the flow rate of hydrogen exiting the cell, the electrolyte temperature and the current are used in the computing means in order to provide a signal which can be sent to the control of the flow rate of the solution to be electrolyzed.

In parallel to the signal which can be sent to the control, the computing means (d) supply the coherent values of the flow rates and of the current. The operating conditions of the electrolytic cell can thus be perfectly determined. The signal(s) sent to the control means represent, in fact, the set points of the various controllers. These signals, which represent the flow rate, temperature or current values, result from the coherence calculation and from one or more criteria which are set, such as, for example, maximum production or a certain value of the current not to be exceeded, and the like. In this manner, in light of the coherent balance resulting from the coherence calculation and according to various criteria, it is possible to actuate the controller(s), that is to say, the set point of the controller(s) is altered manually.

In a preferred embodiment of the invention, it is possible to carry out a coherence treatment of a number of flow rates and to arrange for the computing means (d) to send a number of control signals to one or more of the following components: the means (b) for controlling the flow rates, a means for controlling the current and a means for controlling the temperature.

The coherence treatment will now be explained in detail, using one example of a particular calculation.

A conduit which transports an incompressible fluid is considered, and two mass flowmeters A and B are fitted in this conduit.

Flowmeter A has a turbine sensor and flowmeter B has a sensor with an orifice generating a pressure drop, for example. A simultaneous reading of the two instruments gives:

In the case of the flowmeter A, the value $m_A = 100$

In the case of the flowmeter B, the value $m_B = 105$

Under these conditions, there is a measurement of a single amount by independent means which report two different values of the true value of the measurement, indicated by M in the following.

The problem is to calculate two values $\hat{m}_A$ and $\hat{m}_B$, which are closer to M than are the values $m_A$ and $m_B$.

The manufacturer of the instrument A indicates that a series of n experiments have been carried out on the flow rate M, which have provided a set $W_A$ of measurements M.

The standard deviation of the set $W_A$ is $s_A=2$, for example, and its mean is M.

The set $W_A$ obeys a normal distribution law, that is to say, the probability density of the law is, in a known manner:

$$\frac{1}{S_A\sqrt{2\pi}}\cdot e^{-\frac{1}{2}\left(\frac{M-m}{S_A}\right)^2}$$

The manufacturer of the instrument B indicates that a series of n experiments was also carried out on the flow rate M, thus providing the set $W_B$ of measurements of M.

The standard deviation of the set $W_B$ is $s_B=4$, for example, and its mean is M.

This set also has a probability density:

$$\frac{1}{S_B\sqrt{2\pi}}\cdot e^{-\frac{1}{2}\left(\frac{M-m}{S_B}\right)^2}$$

In set $W_A$, the probability of obtaining a value $m'_A$ which is as close as possible to the value $m_A$ is expressed by:

$$\text{Prob}(m_A - dm/2 < m'_A \leqq m_A + dm/2) = \frac{1}{S_A\sqrt{2\pi}}\cdot e^{-\frac{1}{2}\left(\frac{M-m'_A}{S_A}\right)^2}\cdot dm$$

where dm is the differential element of the variable m.

In set $W_B$, the probability of producing a value $m'_B$ which is as close as possible to the value $m_B$ is expressed by:

$$\text{Prob}(m_B - dm/2 < m'_B \leqq m_B + dm/2) = \frac{1}{S_B\sqrt{2\pi}}\cdot e^{-\frac{1}{2}\left(\frac{M-m'_B}{S_B}\right)^2}\cdot dm$$

When two events A and B are independent, the combined probability of A and B occurring together is expressed by:

$$\text{Prob}(A\cap B)=\text{prob}(A)\times\text{prob}(B).$$

When the following change of variables is carried out:

$$x_A = \frac{M - m'_A}{s_A}$$

$$x_B = \frac{M - m'_B}{s_B}$$

The probability of the values $m'_A$ and $m'_B$, respectively, which are as close as possible to the observed values $m_A$ and $m_B$, occurring simultaneously in the sets $W_A$ and $W_B$ is expressed by:

$$\text{Prob}\,[(m_A - dm/2 < m'_A < m_A + dm/2) \cap (m_B - dm/2 < m'_B < m_B + dm/2)] = \frac{dm^2}{2\pi\cdot S_A\cdot S_B}\cdot e^{\frac{-X_A2}{2}}\cdot e^{\frac{-X_B2}{2}} = \frac{e^{\frac{-(X_A2+X_B2)}{2}}}{2\pi\ S_A\cdot S_B}\cdot dm^2$$

Inspection of the analytical expression which quantifies the required probability shows, obviously, that the probability increases monotonically when the term:

$$\frac{X_A^2 + X_B^2}{2}$$

decreases.

In other words, the probability of simultaneously obtaining the values $m_A$ and $m_B$ in the sets $W_A$ and $W_B$ is maximized when the term:

$$\frac{X_A^2 + X_B^2}{2}$$

is minimized.

Thus when:

$$\frac{X_A^2 + X_B^2}{2}$$

is minimized, the required most probable values of $\hat{m}_A$ and of $\hat{m}_B$ are:

$$\hat{m}_A=m_A+S_AX_A=M+m_A-m'_A$$

$$m_B=m_B+S_BX_B=M+m_B-m'_B.$$

Since the instruments A and B measure a single quantity M, equality of the values $\hat{m}_A$ and $\hat{m}_B$ must be the goal.

The logic constraint on the m estimation is given as $y=\hat{m}_A-\hat{m}_B$. The numerical problem is then to simultaneously calculate the minimum value of:

$$\hat{m}_A=m_A+S_AS_X=M+m_A-m'_A$$

$$\hat{m}_B=m_B+S_BX_B=M+m_B-m'_B$$

$$\frac{X_A^2 + X_B^2}{2}$$

under the constraint y=0.

Since y=0, this is equivalent to obtaining the minimum value of the auxiliary function:

$$z = \frac{X_A^2 + X_B^2}{2} + k\cdot y$$

where k is a new unknown in the problem and is designated a Lagrange multiplier.

The function z has an extreme value when the derivatives with respect to $X_A$ and to $X_B$ cancel each other, namely:

$$\frac{\partial z}{\partial x_A} = 0$$

$$\frac{\partial z}{\partial x_B} = 0$$

When all of the calculations have been performed, these two equations are expressed by the system:

$$\begin{cases} X_A + kS_A = 0 \\ X_B - kS_B = 0 \end{cases} \quad (1)$$

The variables $X_A$ and $X_B$, replaced in the constraint expression ($m_A+S_AX_A=m_B+S_BX_B$) then give:

$$kS_A^2+kS_B^2=m_A-m_B$$

that is to say:

$$k = \frac{m_A - m_B}{S_A^2 + S_B^2}$$

The value of k applied to the system (1) gives:

$$X_A = \frac{-S_A \cdot (m_A - m_B)}{S_A^2 + S_B^2}$$

$$X_B = \frac{S_B \cdot (m_A - m_B)}{S_A^2 + S_B^2}$$

Finally:

$$\hat{m}_A = m_A - \frac{S_A^2 \cdot (m_A - m_B)}{S_A^2 + S_B^2}$$

$$\hat{m}_B = m_B + \frac{S_B^2 \cdot (m_A - m_B)}{S_A^2 + S_B^2}$$

The numerical application of the preceding results is:

$$\hat{m}_A = 100 - \frac{4(100 - 105)}{4 + 16} = 100 + 1 = 101$$

$$\hat{m}_B = 105 + \frac{16(100 - 105)}{4 + 16} = 105 - 4 = 101$$

The most probable value (and not the value which is certainly the closest) of M is equal to 101.

The coherent values of the measurements $\hat{m}_A$ and $\hat{m}_B$ are:

$$\hat{m}_A=\hat{m}_B=101$$

The certainty of obtaining values m which are closer to the true value than are the crude values m is obtained by multiplying the readings of the crude measurements and their mathematical adjustment.

The reduction in the error is 50% in the case of measurement A and 66% in the case of measurement B, in the event that the true value is equal to 102, and the residual error of B then changes in direction.

The efficiency of the treatment increases with the number of redundancies in the crude measurements and with the number of repeated treatments, and also with the absolute accuracies and/or errors in the measurements. The coherence calculation may be extended to any number of crude measurements subjected to a certain number of constraints, provided, of course, that the number of constraints is smaller than the number of measurements. For example, the method described by G. V. Reklaitis, A. Ravindran and K. M. Ragsdell in "Engineering Optimization, Methods and Applications", published by John Wiley and Sons, pages 184–189 (1983), may be employed The coherence calculation takes into account, for example, the conservation of the atoms in a chemical reaction, the conservation of the enthalpy balance, and the conservation of electrons, of charges, or of the electrochemical balance.

In another embodiment of the invention, the signal improved by the coherence treatment is directly sent to at least one of the means (b) for controlling the flow rates, a means for controlling the current and the means for controlling the temperature. This linking is effected by the same means as, for example, the linking of the measuring means (a) and of the computing means (d); these are analog, digital, electrical or pneumatic linkages, or a combination of these techniques, for example depending on the distances and the powers of the signals necessary to actuate the controllers. In another embodiment of the invention, not all of the computing means (d) are directly sent to the control means. For example, it is possible to have a direct control of an inlet flow rate and a signal applicable to the inlet temperature of the electrolyte; the set point of this electrolyte inlet temperature is therefore altered manually.

In a preferred embodiment of the invention, the electrolysis cell may comprise means of measurement (e) supplying signals of measurement of the concentrations of at least one of the inlet materials and the outlet products, and these signals are linked to the computing means (d).

By "concentrations" are intended the concentrations in the case of a liquid phase or the pH or the concentration or partial pressure in the case of a gaseous phase. It is not necessary to measure all of the concentrations of an inlet or outlet material. In chlorine/sodium hydroxide electrolysis, for example, it is sufficient to determine the concentration of oxygen in the exiting chlorine. On being added to the preceding measurements, namely, the flow rate of one of the inlet or outlet materials, the temperature of the electrolyte and the current, this measurement enables the coherence to be improved. In another preferred embodiment of the invention, concentrations of other inlet or outlet materials may be measured, or a number of concentrations of one of the materials and only one concentration of another material. For example, in the case of the chlorine/sodium hydroxide electrolysis, it is preferred to measure the oxygen in the chloride, and both the sodium hydroxide and the chloride in the material exiting the cell.

In another preferred embodiment of the invention, the computing means (d) may also send one or more signals improved by the coherence treatment and applicable to the means for controlling an element of the concentration of an inlet or outlet material. For example, the concentration of the compound which is to be electrolyzed in the inlet material may be modified by adding a diluent, or the pure material to be electrolyzed, in order to increase its concentration. Thus, for example, in the electrolysis of sodium chloride, sodium chloride may be added to the inlet material to increase the concentration of chloride, or water may be added to lower this concentration; its pH may also be modified.

As in the case of the inlet or outlet materials, it is possible to measure one concentration and to control another, either of the same or of another inlet or outlet material. The means (d) can also supply signals which can be applied and signals which are applied directly.

In another preferred embodiment of the invention, the cell may comprise means (f) for measuring at least one of the parameters of pressure and temperature, such a parameter constituting part of at least one of the elements selected from among the inlet materials, the outlet materials and the cell compartments. These measuring means (f) are linked to the computing means (d).

Quite obviously, these temperatures do not concern the temperature of the electrolyte in the electrolysis cell, which is always taken into consideration.

In another preferred embodiment of the invention, the cell may comprise means (g) for controlling at least one of the parameters of pressure and temperature, such a parameter constituting part of at least one of the elements selected from among the inlet materials and the outlet materials. These computing means (d) supply control signals, some being applicable to the control means (g) and others applied directly to the means (g).

The pressure or the temperature which is controlled by a signal emanating from the computing means (d) may be that which has been measured, or another. Thus, for example, it is possible to measure the temperature of the inlet material to be electrolyzed, to take this measurement into account in the calculation of coherence and to control the pressure of a gas originating at one of the electrodes by a signal which is improved by the coherence calculation and which originates from the computing means.

The present invention is particularly useful in chlorine/sodium hydroxide electrolysis.

Upon using the control device of the invention, experience shows that the coherence treatment carried out on the values of the measured concentrations, of the flow rates and of the current, enables this installation to operate at an optimum efficiency. In the conventional facilities, which do not employ this coherence treatment in an application of this type, and which, in particular, do not carry out a coherence treatment of the flow rate values of the inlet reactant compounds as well as the current and, if desired, the values of the concentrations of the final products, the efficiency is much lower.

The present invention is more particularly useful in the case of the membrane electrolysis process, it being possible for the hydrogen stream to be linked directly to the electron stream.

The computing means also provide the intermediate steps of the calculations and, above all, the most probable values, which can therefore be compared with the measured values. Their difference is expressed in the form of a correction coefficient. Continuous display of these correction coefficients permits the operation of the cell (or of a group of cells) to be managed, while full control over the process is maintained.

In order to further illustrate the present invention and the advantages thereof, the following specific example is given, it being understood that same is intended only as illustrative and in nowise limitative.

EXAMPLE

The following example illustrates operation of a chlorine/sodium hydroxide electrolysis cell of a membrane process.

| MEASURED VALUES: | |
|---|---|
| Inlet brine flow rate (l/h) | 950 |
| Inlet brine temperature (°C.) | 44 |
| Inlet NaCl concentration (g/l) | 303.8 |
| Inlet sulfate concentration (as $SO_4$) (g/l) | 2.9 |
| Inlet NaOH concentration (g/l) | 0.22 |
| Inlet $Na_2CO_3$ concentration (g/l) | 0.87 |
| Inlet pH | 8 |
| Inlet sodium hydroxide/water flow rate (l/h) | 74 |
| Inlet sodium hydroxide/water temperature (°C.) | 40 |
| Inlet sodium hydroxide/water concentration (mass %) | 0.0001 |
| Outlet sodium hydroxide flow rate (l/h) | 229 |
| Outlet sodium hydroxide temperature (°C.) | 84 |
| Outlet sodium hydroxide concentration (mass %) | 33.1 |
| Outlet brine flow rate (l/h) | 765 |
| Outlet brine temperature (°C.) | 82 |
| Outlet salt concentration (g/l) | 209.1 |
| Outlet sulfate concentration (as $SO_4$) (g/l) | 3.6 |
| Outlet ClO concentration (as ClO) (g/l) | 1.99 |
| Outlet $ClO_3$ concentration (as $ClO_3$) (g/l) | 0.16 |
| Outlet pH | 3.9 |
| Oxygen in chlorine (volume %) | 2.4 |
| Cell current (kA) | 70.5 |
| Cell voltage (volt) | 3.43 |
| Outlet $H_2$ pressure (mmWG) | 40 |
| Outlet $Cl_2$ pressure (mmWG) | 20 |
| Ambient temperature (°C.) | 25 |
| Relationship between the relative error of the current measurement and the relative errors in the other flowstreams | 0.1 |

| "DEMA" AND CORRECTED "DEMAC" FLOW MEASUREMENTS | MEASURED VALUES | MEASUREMENT ERRORS IN % | COHERENT VALUES | DIFFERENCE IN % |
|---|---|---|---|---|
| No. 1: Curent in amperes | 70500.0 | 0.5 | 70453.6 | 0.065 |
| No. 2: Water in inlet brine g/h | 831375.4 | 5.0 | 869903.7 | −4.634 |
| No. 3: Salt in inlet brine g/h | 288610.0 | 5.0 | 302221.7 | −4.716 |
| No. 4: Sulfate in inlet brine g/h | 4075.1 | 5.0 | 4074.8 | 0.006 |
| No. 5: HCl in inlet brine g/h | 0.0 | 5.0 | 0.0 | 0.000 |
| No. 6: Sodium hydroxide in inlet brine g/h | 209.0 | 5.0 | 209.0 | 0.007 |
| No. 7: Carbonate in inlet brine g/h | 826.5 | 5.0 | 826.7 | 0.035 |
| No. 8: Water in outlet brine g/h | 680939.8 | 5.0 | 669913.4 | 1.619 |

-continued

| "DEMA" AND CORRECTED "DEMAC" FLOW MEASUREMENTS | MEASURED VALUES | MEASUREMENT ERRORS IN % | COHERENT VALUES | DIFFERENCE IN % |
|---|---|---|---|---|
| No. 9: Salt in outlet brine g/h | 159961.5 | 5.0 | 157264.5 | 1.685 |
| No. 10: Dissolved chlorine in outlet brine g/h | 156.1 | 5.0 | 156.1 | −0.025 |

| "DEMA" AND CORRECTED "DEMAC" FLOW MEASUREMENTS | MEASURED VALUES | MEASUREMENT ERRORS IN % | COHERENT VALUES | DIFFERENCE IN % |
|---|---|---|---|---|
| No. 11: Sulfate in outlet brine g/h | 4073.6 | 5.0 | 4074.8 | −0.029 |
| No. 12: Chlorate in outlet brine g/h | 489.7 | 5.0 | 490.0 | −0.057 |
| No. 13: Hypochlorite in outlet brine g/h | 1551.9 | 5.0 | 1555.4 | −0.227 |
| No. 14: HCl in outlet brine g/h | 3.5 | 5.0 | 3.5 | 0.000 |
| No. 15: Water/sodium hydroxide feed, water flow rate g/h | 73790.5 | 5.0 | 73535.9 | 0.345 |
| No. 16: Water/sodium hydroxide feed, sodium hydroxide flow rate g/h | 0.0 | 5.0 | 0.0 | 0.345 |
| No. 17: Sodium hydroxide outlet, water flow rate g/h | 208252.1 | 5.0 | 201893.2 | 3.053 |

| "DEMA" AND CORRECTED "DEMAC" FLOW MEASUREMENTS | MEASURED VALUES | MEASUREMENT ERRORS IN % | COHERENT VALUES | DIFFERENCE IN % |
|---|---|---|---|---|
| No. 18: Sodium hydroxide outlet, sodium hydroxide flow rate g/h | 103036.5 | 5.0 | 99890.3 | 3.053 |
| No. 19: $H_2$ outlet, entrained water flow rate g/h | 8087.1 | 5.0 | 8081.8 | 0.065 |
| No. 20: $H_2$ outlet, hydrogen flow rate g/h | 2630.2 | 5.0 | 2628.5 | 0.065 |
| No. 21: $Cl_2$ outlet, entrained water flow rate g/h | 16704.4 | 5.0 | 17198.3 | −2.956 |
| No. 22: $Cl_2$ outlet, chlorine flow rate g/h | 84037.1 | 5.0 | 86368.2 | −2.773 |
| No. 23: $Cl_2$ outlet, oxygen flow rate g/h | 909.0 | 5.0 | 913.1 | 0.454 |
| No. 24: $Cl_2$ outlet, $CO_2$ flow rate g/h | 343.0 | 5.0 | 343.1 | 0.036 |

| RECONSTITUTION OF THE COHERENT FLOWS: | |
|---|---|
| Cell current | 70454 amperes |
| Cathodic faraday efficiency | 95.01 % |
| Anodic faraday efficiency | 92.56 % |
| Anodic faraday efficiency | 95.34 % |

-continued

| RECONSTITUTION OF THE COHERENT FLOWS: | |
|---|---|
| | after dechlorination |
| Corrected brine inlet: | |
| Flow rate | 994.0 l/h |
| NaCl concentration | 340.0 g/l |

-continued

| RECONSTITUTION OF THE COHERENT FLOWS: | |
|---|---|
| Sulfate concentration | 2.77 g/l |
| Corrected brine outlet: | |
| Flow rate | 752.6 l/h |
| NaCl concentration | 209.0 g/l |
| Sulfate concentration (in $SO_4$) | 3.66 g/l |
| Chlorate concentration (in $ClO_3$) | 0.163 g/l |
| ClO concentration (in ClO) | 2.03 g/l |
| Corrected sodium hydroxide/water inlet: | |
| Sodium hydroxide/water input flow rate | 73.7 l/h |
| Sodium hydroxide input concentration | 0.0 % |
| Corrected sodium hydroxide outlet: | |
| Sodium hydroxide outlet flow rate | 222.0 l/h |
| Sodium hydroxide outlet concentration | 33.10 % |
| Chlorine purity: | |
| Oxygen/chlorine percentage | 2.33 % |
| Cell output: | |
| Cell terminal chlorine flow rate | 86.368 kg/h |
| Total chlorine flow rate | 88.962 kg/h |
| 100% sodium hydroxide output | 99.890 kg/h |
| Hydrogen outlet | 2.629 kg/h |
| HCl for dechlorination | 1.08 kg/h as 100% |
| Electricity consumption: | |
| Sodium hydroxide A production | 2419.0 kWh/tonne of 100% |
| Chlorine A production | 2716.0 kWh/tonne of total chlorine |

Only the results of the coherence calculation have been shown in this example. For reasons of clarity, it is not possible to demonstrate the variations of these parameters over the course of time. Some controller set points may be modified using the coherent values. In this illustrative example, it was elected to control the flow rates and the temperature of the brine inlet and the flow rates and the temperature of the water supply.

Another advantage of the invention is thus apparent, namely, by consulting the relative differences, it is possible to determine which measurement is defective and then to correct same.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. An electrolytic cell including an operation control system therefor, said control system comprising:

(a) measuring means for supplying signals of measurement of the flow rates of at least one of the inlet starting materials to the cell or of at least one of the outlet final products therefrom;

(b) optionally, means for controlling the flow rate of at least one of the inlet or outlet materials/-products;

(c) at least one means for measuring the temperature of the electrolyte, and, optionally, at least one means for controlling this temperature;

(d) computing means linked to the means (a) for measuring flow rates, and to the means (c) for measuring the temperature of the electrolyte, and further wherein:

(i) the computing means (d) are linked to at least one means for measuring cell current;

(ii) the computing means (d) are adopted to conduct corrective coherence treatments of the flow rate measurements supplied by the measuring means (a) and of the measurement of the current; and, (iii) the computing means (d) supply at least one signal improved by such corrective coherence treatment and applicable to at least one of (1) the measuring means (b) for controlling the flow rates, (2) a means for controlling the current and/or (3) the means for controlling the temperature.

2. The electrolytic cell as defined by claim 1, wherein said computing means (d) supply at least one control signal directly sent to at least one of (1) the measuring means (b) for controlling the flow rates, (2) a means for controlling the current and/or (3) the means for controlling the temperature.

3. The electrolytic cell as defined by claim 1, said control system further comprising means of measurement (e) supplying signals of measurement of the concentrations of at least one of the inlet starting materials and the outlet final products, and means for linking such signals to the computing means (d).

4. The electrolytic cell as defined by claim 1, said control system further comprising means (f) for measuring at least one of the parameters of pressure and temperature of at least one of the inlet materials, outlet products and/or the compartments of the cell, and said means of measurement (f) being linked to the computing means (d).

5. The electrolytic cell as defined by claim 1, comprising a chlorine/sodium hydroxide electrolysis cell.

6. The electrolytic cell as defined by claim 1, wherein said computing means (d) performs calculations based on a comparison of measurements made by said flow rate measuring means (a) and measurements made by said means for measuring cell current in carrying out said corrective coherence treatments and signal supplying functions of said computing means (d).

7. The electrolytic cell as defined by claim 6, wherein said computing means (d) correlates said measurements made by said flow rate measuring means (a) and said means for measuring cell current and determines most probable values of said measured values.

8. The electrolytic cell as defined by claim 7, wherein said computing means (d) further determines most probable values of at least one operating condition of said cell which is not measured.

9. The electrolytic cell as defined by claim 1, wherein said computing means (d) performs calculations based on a comparison of measurements made by said flow rate measuring means (a), measurements made by said temperature measuring means (c) and measurements made by said means for measuring cell current in carrying out said corrective coherence treatments and signal supplying functions of said computing means (d).

10. The electrolysis cell as defined by claim 9, wherein said computing means (d) correlates said measurements made by said flow rate measuring means (a), said temperature measuring means (c) and said means for measuring cell current and determines probable values of said measured values.

11. The electrolytic cell as defined by claim 10, wherein said computing means (d) further determines most probable values of at least one operating condition of said cell which is not measured.

* * * * *